US007654333B2

(12) United States Patent
Smith

(10) Patent No.: US 7,654,333 B2
(45) **Date of Patent: *Feb. 2, 2010**

(54) DOWNHOLE SAFETY VALVE

(75) Inventor: Roddie R. Smith, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 16 days.

This patent is subject to a terminal disclaimer.

(21) Appl. No.: 11/384,720

(22) Filed: Mar. 20, 2006

(65) Prior Publication Data

US 2006/0157255 A1 Jul. 20, 2006

Related U.S. Application Data

(63) Continuation-in-part of application No. 10/957,240, filed on Oct. 1, 2004, now Pat. No. 7,246,668.

(60) Provisional application No. 60/664,487, filed on Mar. 23, 2005.

(51) Int. Cl.
*E21B 34/00* (2006.01)
*E21B 34/08* (2006.01)

(52) U.S. Cl. ..... 166/386; 166/332.8; 166/373

(58) Field of Classification Search ..... 166/381, 166/373, 386, 321, 324, 319, 332.8
See application file for complete search history.

(56) References Cited

U.S. PATENT DOCUMENTS 3,782,461 A 1/1974 Watkins
3,786,867 A 1/1974 Tausch et al.
3,814,181 A 6/1974 Young
3,826,309 A 7/1974 Tausch
3,860,066 A 1/1975 Pearce et al.
4,014,386 A 3/1977 Johnson et al.
4,119,146 A 10/1978 Taylor
4,173,256 A 11/1979 Kilgore
4,252,197 A 2/1981 Pringle
4,273,186 A 6/1981 Pearce et al.
4,339,001 A 7/1982 Paschal, Jr.
4,373,587 A 2/1983 Pringle
4,428,557 A 1/1984 Yonker et al.
4,431,051 A 2/1984 Adams, Jr.

(Continued)

FOREIGN PATENT DOCUMENTS

EP 1 519 005 3/2005

(Continued)

OTHER PUBLICATIONS

GB Search Report, Application No. 0605750.9, Dated Jul. 21, 2006.

(Continued)

*Primary Examiner*—Jennifer H Gay
*Assistant Examiner*—David Andrews
(74) *Attorney, Agent, or Firm*—Patterson & Sheridan, L.L.P.

(57) ABSTRACT

The present invention generally provides a method and apparatus for selectively sealing a bore. The tubular valve generally includes a closing member for seating in and closing the bore, and a pressure-actuated, retention member having first and second opposed piston surfaces opening and closing the valve. The tubular valve prevents sudden loss of pressure in the tubular and is controllable from the surface.

51 Claims, 8 Drawing Sheets

U.S. PATENT DOCUMENTS

| | | | | |
|---|---|---|---|---|
| 4,444,266 | A | 4/1984 | Pringle | |
| 4,467,867 | A | 8/1984 | Baker | |
| 4,469,180 | A | 9/1984 | Turner | |
| 4,598,773 | A | 7/1986 | Pringle | |
| 4,621,695 | A | 11/1986 | Pringle | |
| 4,660,646 | A | 4/1987 | Blizzard | |
| 4,664,195 | A | 5/1987 | Deaton | |
| 4,911,199 | A | 3/1990 | Bontenbal et al. | |
| 4,976,317 | A | 12/1990 | Leismer | |
| 5,176,220 | A | 1/1993 | Akkerman | |
| 5,310,004 | A | 5/1994 | Leismer | |
| 5,411,096 | A * | 5/1995 | Akkerman | 166/321 |
| 5,415,237 | A | 5/1995 | Strattan | |
| 5,564,501 | A | 10/1996 | Strattan et al. | |
| 5,857,523 | A * | 1/1999 | Edwards | 166/374 |
| 5,906,220 | A | 5/1999 | Thompson | |
| 6,003,605 | A | 12/1999 | Dickson et al. | |
| 2003/0155131 | A1 * | 8/2003 | Vick, Jr. | 166/375 |
| 2006/0021757 | A1 * | 2/2006 | Patel | 166/386 |

FOREIGN PATENT DOCUMENTS

| | | |
|---|---|---|
| GB | 2 418 687 | 4/2006 |

OTHER PUBLICATIONS

Great Britain Examination Report, Application No. GB0605750.9, dated Jun. 25, 2009.

* cited by examiner

DOWNHOLE SAFETY VALVE

CROSS-REFERENCE TO RELATED APPLICATIONS

This application is a continuation-in-part of U.S. patent application Ser. No. 10/957,240 filed Oct. 1, 2004 now U.S. Pat No. 7,246,668. Further, this application claims benefit of U.S. provisional patent application Ser. No. 60/664,487 filed Mar. 23, 2005, which is herein incorporated by reference. Each of the aforementioned related patent applications are herein incorporated by reference.

BACKGROUND OF THE INVENTION

1. Field of the Invention

Embodiments of the present invention generally relate to safety valves. More particularly, embodiments of the present invention pertain to subsurface safety valves configured to actuate using wellbore pressure in the event of an unexpected pressure drop. More particularly still, embodiments of the present invention pertain to the further ability to control the safety valves from the surface.

2. Description of the Related Art

Subsurface safety valves are commonly used to shut-in oil and gas wells. The safety valves are typically fitted in a string of production tubing installed in a hydrocarbon producing well. The safety valves are configured to selectively seal fluid flow through the production tubing to control the flow of formation fluids upwardly should a failure or hazardous condition occur at the well surface.

Typically, subsurface safety valves are rigidly connected to the production tubing and may be installed and retrieved by known conveyance methods, such as tubing or wireline. During normal production, safety valves are maintained in an open position by the application of hydraulic fluid pressure transmitted to an actuating mechanism. The actuating mechanism in such embodiments may be charged by application of hydraulic pressure through hydraulic control systems. Hydraulic control systems may comprise a clean oil supplied from a surface fluid reservoir through a control line. A pump at the surface delivers regulated hydraulic fluid under pressure from the surface to the actuating mechanism through the control line. The control line resides within the annular region between the production tubing and the surrounding well casing.

In the event of a failure or hazardous condition at the well surface, fluid communication between the surface reservoir and the control line is interrupted. This, in turn, breaks the application of hydraulic pressure against the actuating mechanism. The actuating mechanism recedes within the valve, allowing a flapper to quickly and forcefully close against a corresponding annular seat—resulting in shutoff of the flow of production fluid. In many cases, the flapper can be reopened (and production flow resumed) by restoring the hydraulic fluid pressure to the actuating mechanism of the safety valve via the control lines.

For safety reasons, most surface controlled subsurface safety valves (such as the ones described above) are "normally closed" valves, i.e., the valves are in the closed position when the hydraulic pressure in the control lines is not present. The hydraulic pressure typically works against a powerful spring and/or gas charge acting through a piston. In many commercially available valve systems, the power spring is overcome by hydraulic pressure acting against the piston, producing axial movement of the piston. The piston, in turn, acts against an elongated "flow tube." In this manner, the actuating mechanism is a hydraulically actuated and axially movable piston that acts against the flow tube to move it downward within the tubing and across the flapper. These safety valves require a control system for operation from the surface in order to open the valve and produce.

Safety valves employing control lines, as described above, have been implemented successfully for standard depth wells with reservoir pressures that are less than 15,000 psi. However, wells are being drilled deeper, and the operating pressures are increasing correspondingly. For instance, formation pressures within wells developed in some new reservoirs are approaching 30,000 psi. In such downhole environments, conventional safety valves utilizing control lines are not operable because of the pressure limitations of the control line. In other words, high-pressure wells have exceeded the capability of many existing control systems.

Therefore, a need exists for a subsurface safety valve that is equipped with a self contained control system without control lines conveying hydraulic fluid to an actuating mechanism. A further need exists for a subsurface safety valve that is suitable for use in high pressure environments. There is yet a further need for the ability to reopen the safety valve remotely from the surface of the well. There is a further need for the ability to close the safety valve from the surface.

SUMMARY OF THE INVENTION

The present invention generally can be a wireline or a tubing safety valve which can be operated from the surface of the well.

The present invention generally provides a method and apparatus for selectively sealing a bore. The tubular valve generally includes a closing member for seating in and closing the bore, and a pressure-actuated, retention member having first and second opposed piston surfaces opening and closing the valve. The tubular valve prevents sudden loss of pressure in the tubular and is controllable from the surface.

In one embodiment the invention is a downhole valve for selectively sealing a bore. The valve includes a closing member for sealing the bore, a retention member having first and second piston surfaces for initially holding the closing member in an open position, a pressure chamber for applying pressure to the second piston surface, and a control line in communication with the pressure chamber.

In another embodiment the invention is a method of operating a downhole valve. The method includes providing the valve in a downhole tubular, the valve having: a closing member for sealing a bore, a retention member having a first and second piston surface, mechanically biased to interfere with a closing member normally keeping the valve open, a pressure chamber in communication with the second piston surface and a control line in communication with the pressure chamber. The method further includes applying a wellbore pressure to the first piston surface and increasing the pressure in the pressure chamber to a level sufficient to overcome the mechanical bias of the retention member, but insufficient to overcome both the pressure on the first piston surface and the mechanical bias.

In yet another embodiment the invention is a downhole valve. The valve includes a flapper mechanically biased to seal a bore, a retention member mechanically biased to interfere with the flapper to maintain the bore in the open position, a pressure chamber for controllably moving the retention member out of interference with the flapper, a control line for controlling the pressure chamber, and a bore pressure for applying a force to the retention member.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The apparatus and methods of the present invention allow for a safety valve for subsurface wells. Embodiments of the present invention provide safety valves that utilize normal wellbore pressure for actuation of the valve, which removes the need for hydraulic systems with control lines extending from the surface to the valve, however, a control system is incorporated into the invention for further control of the valve.

Figure 1:
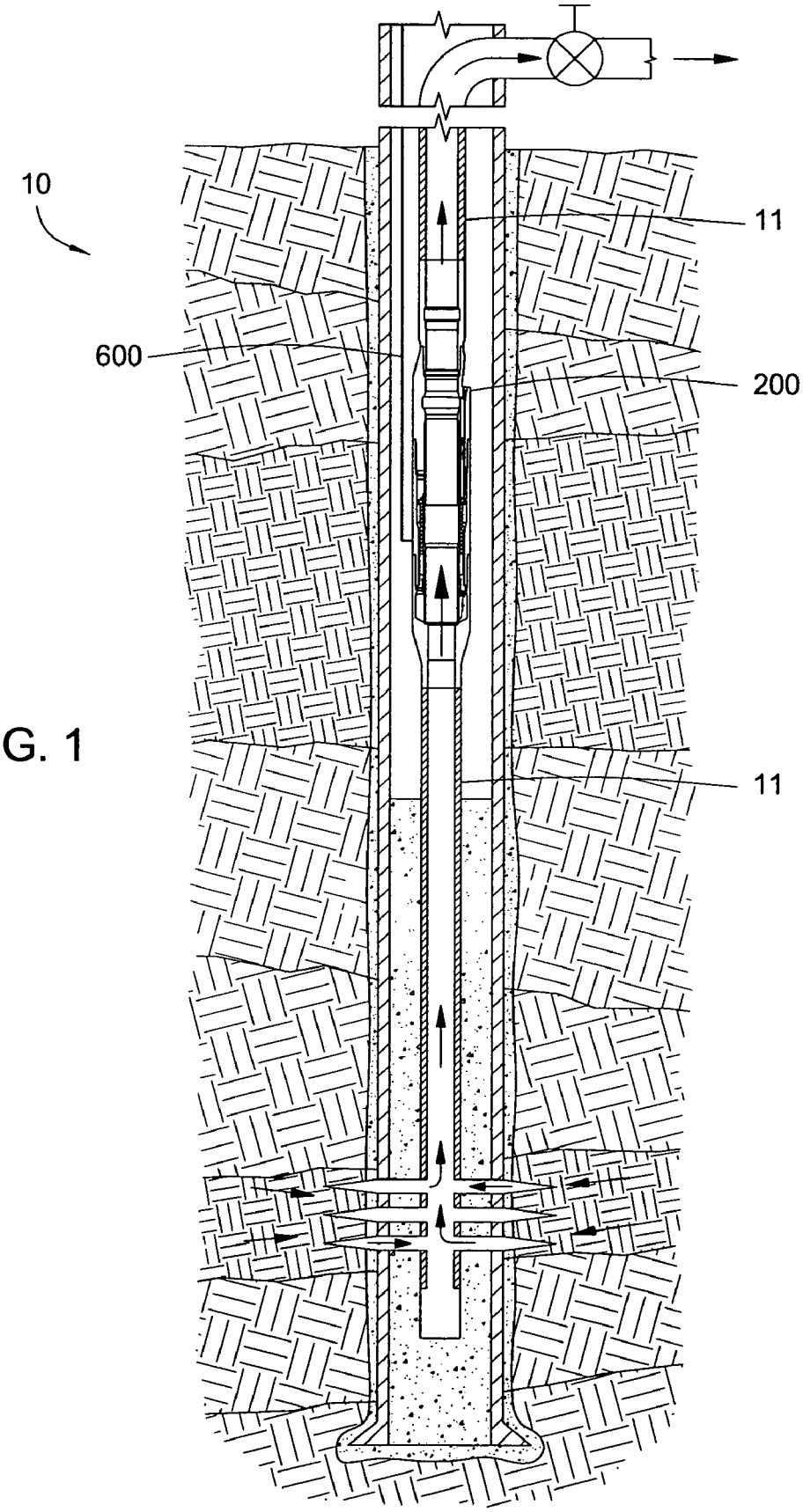
FIG. 1 is a cross-sectional view of a wellbore illustrating a string of production tubing having a subsurface safety valve in accordance with one embodiment of the present invention.

FIG. 1 is a cross-sectional view of an illustrative wellbore 10. The wellbore is completed with a string of production tubing 11. The production tubing 11 defines an elongated bore through which servicing fluid may be pumped downward and production fluid may be pumped upward. The production tubing 11 includes a safety valve 200 in accordance with one embodiment of the present invention. The safety valve 200 controls the upward flow of production fluid through the production tubing 11 in the event of a sudden and unexpected pressure loss (also referred to herein as a "pressure drop"). The pressure drop may coincide with a corresponding increase in flow rate within the production tubing 11. Such a condition could be due to the loss of flow control (i.e., a blowout) of the production fluid at the wellbore surface. In the event of such a condition, a subsurface safety valve, implemented according to embodiments of the current invention, automatically actuates and shuts off the upward flow of production fluid. Further, when flow control is regained at the surface, the safety valve is remotely reopened to reestablish the flow of production fluid. Further still, the safety valve is remotely closed or opened to shut off or reestablish flow of production fluid at any time through use of a control line 600. Discussion of the components and operation of embodiments of the safety valve of the present invention are described below with reference to FIGS. 2A-2B, 3A-3B, 4A-4C, 5 and 6.

It should be understood, that as used herein, the term "production fluid" may represent both gases or liquids or a combination thereof. Those skilled in the art will recognize that production fluid is a generic term used in a number of contexts, but most commonly used to describe any fluid produced from a wellbore that is not a servicing (e.g., treatment) fluid. The characteristics and phase composition of a produced fluid vary and use of the term often implies an inexact or unknown composition.

Figure 2A:
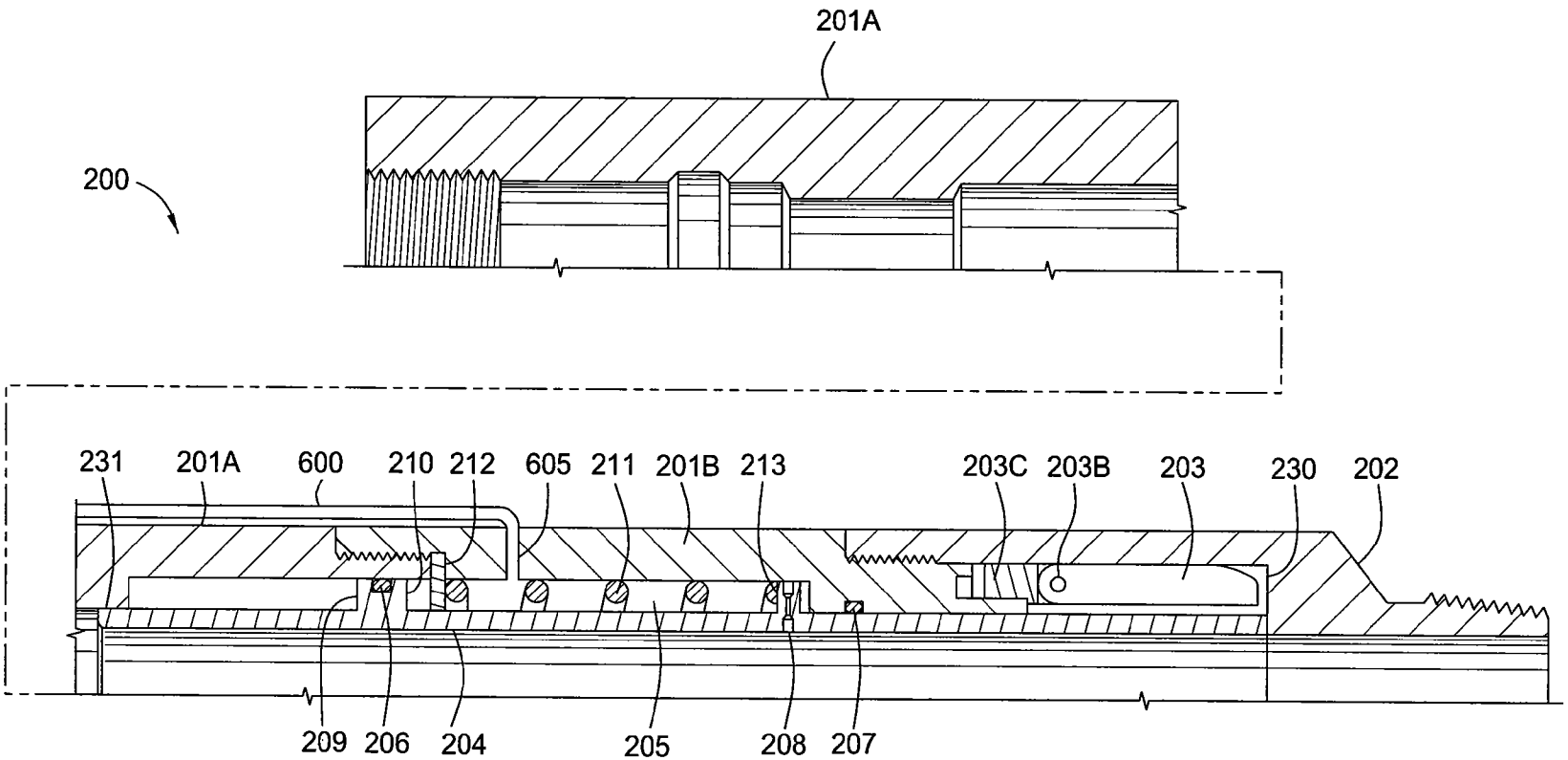
FIG. 2A is a cross-sectional view of the subsurface safety valve in an open position.

FIG. 2A illustrates a cross-sectional view of a subsurface safety valve in an open position, in accordance with one embodiment of the present invention. The safety valve 200 comprises an upper housing 201A threadedly connected to a lower housing 201B, which, in turn, is threadedly connected to a bottom sub 202. The upper housing 201A makes up the top of the safety valve 200 and extends upward. Accordingly, the bottom sub 202 makes up the bottom of the safety valve 200 and extends downward. Both the upper housing 201A and the bottom sub 202 are configured with threads to facilitate connection to production tubing 11 (or other suitable downhole tubulars) above and below the safety valve 200, respectively.

The safety valve 200 comprises a flapper 203 and a flow tube 204. The flapper 203 is rotationally attached by a pin 203B to a flapper mount 203C. The flapper 203 is mechanically or hydraulically biased toward the closed position. The flapper 203 pivots between an open position and a closed position in response to axial movement of the flow tube 204. As shown in FIG. 2A, the flapper 203 is in the open position creating a fluid pathway through the bore of the flow tube 204, thereby allowing the flow of fluid through the safety valve 200. Conversely, in the closed position, the flapper 203 blocks the fluid pathway through the bore of the flow tube 204, thereby preventing the flow of fluid through the valve 200.

As stated earlier, FIG. 2A illustrates the safety valve 200 in the open position. In the open position, the flow tube 204 physically interferes with and restricts the flapper 203 from closing. As will be described with reference to FIG. 2B, when the safety valve 200 is in the closed position, the flow tube 204 translates sufficiently upward to enable the flapper 203 to close completely and shut off flow of production fluid.

While production fluid is conveyed to the surface under stable and controlled conditions, the safety valve 200 remains in the open position. Under such conditions, the flow tube 204 remains bottomed out against an upward facing internal shoulder 230 of the bottom sub 202, thereby restricting the flapper 203 from closing. The flow tube 204 is held in this position due to a net downward force resulting from the force exerted by a spring 211 biased towards the extended position. A gap 231 between the inner diameter of the upper housing 201A and the outer diameter of the flow tube 204 allows a piston surface 209 to be in fluid communication with the wellbore.

As shown in FIG. 2A, a pressure chamber 205 is located in the annular space between the outer diameter of the flow tube 204 and the inner diameter of the lower housing 201B. The pressure chamber 205 is bound by a piston seal 206 on top and the tube seal 207 on bottom. The pressure chamber 205 contains an opening 605 with a control line 600 attached to it. The control line 600 allows for adjustment of the pressure in the pressure chamber 205 from the surface. A spring 211 is also located in the annular area between lower housing 201B and the flow tube 204. The spring is held in place by a spring retainer 212 and surface 213 of the flow tube 204.

In one embodiment, during normal operation, while the valve 200 is in the open position, the pressure chamber 205 is filled with production fluid that enters the pressure chamber 205 through an orifice 208. The orifice 208 meters flow that passes through it, regardless of whether the fluid is entering or exiting the pressure chamber 205. While the valve 200 is in the open position, the fluid flow through the orifice 208 ensures that the pressure of the fluid inside the pressure chamber 205, acting on surface 210 eventually equalizes with the pressure of the fluid flowing through the bore of the flow tube 204 and acting on the piston surface 209.

Figure 2B:
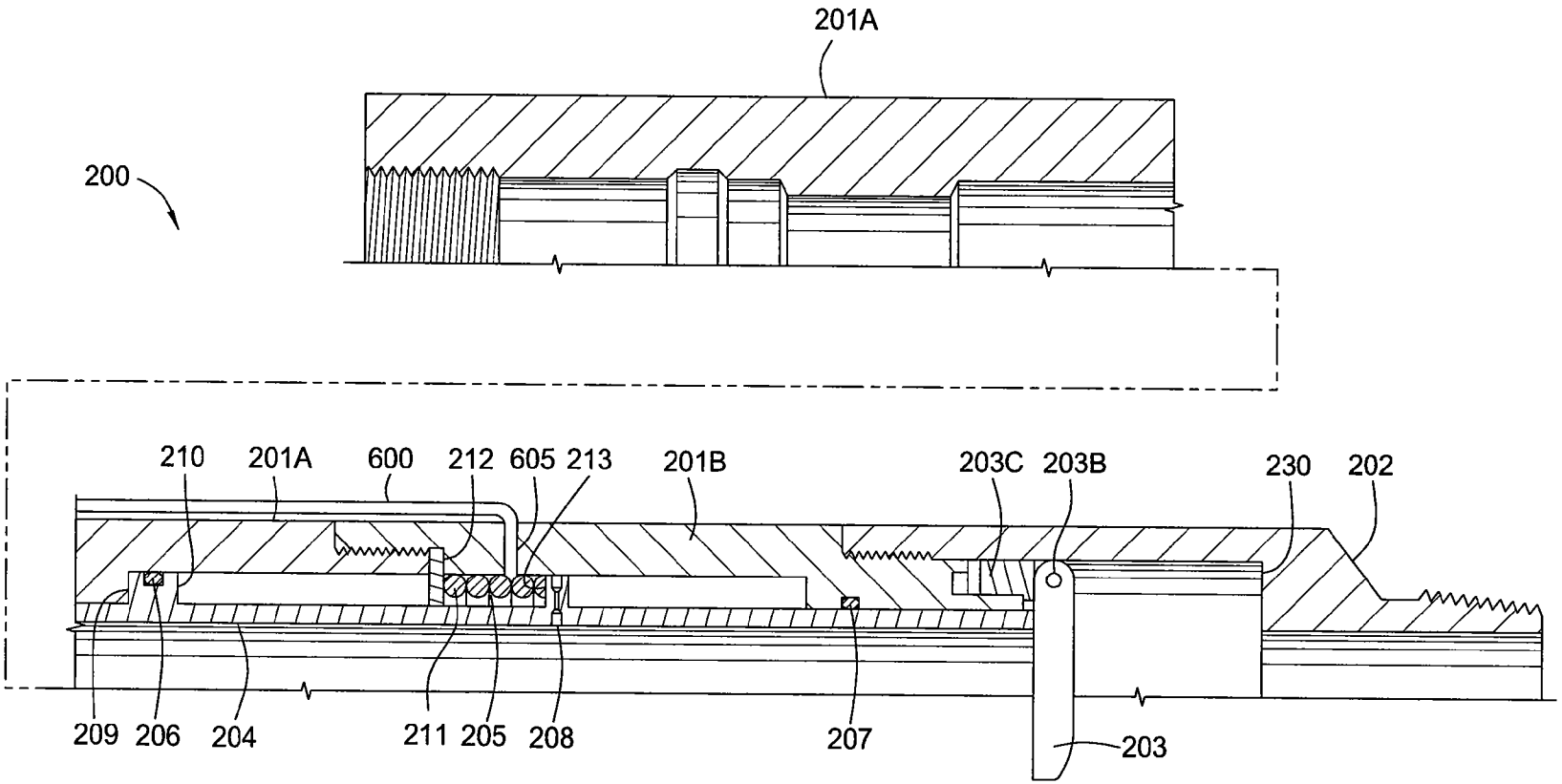
FIG. 2B is a cross-sectional view of the subsurface safety valve of FIG. 2A, shown in the closed position.

In the event of a catastrophic failure at the surface of the wellbore and loss of flow control, the safety valve 200 automatically closes, as seen in FIG. 2B. The loss of flow control typically means that production fluid is flowing upward at a flow rate that is much higher than normal. In keeping with Bernoulli's Rule, the pressure of production fluid flowing through the bore of the flow tube 204 is much lower than prior to loss of flow control. However, the pressure in the pressure chamber 205 is not reduced in unison with the production flow pressure. This is because the metering effect of the orifice 208 does not allow the fluid to flow out of the pressure chamber 205 to allow for the equalization process to occur immediately. Accordingly, for a particular time span, the pressure of the fluid flowing through the bore and acting on the piston surface 209 is appreciably lower than the pressure of fluid in the pressure chamber 205 acting on the surface 210.

The pressure difference between the fluid within the pressure chamber 205 and the production fluid results in the pressure chamber 205 increasing in volume and the flow tube 204 being urged upward. It should be noted that as the flow tube 204 moves upward, it meets resistance as the spring 211 is compressed. Provided that the pressure difference is large enough and the pressure chamber 205 expands sufficiently, the flow tube 204 travels sufficiently upward so that it no longer restricts the flapper 203 from closing as seen in FIG. 2B.

Further, the safety valve 200 can close at any time through use of control line 600. The control line 600 monitors and regulates the pressure in the pressure chamber 205 at the surface. To close the safety valve 200 the control line 600 increases the pressure in the pressure chamber 205 until the pressure acting on surface 210 is large enough to overcome the spring 211 force and the pressure acting on piston surface 209. The control line 600 can further remove pressure from the pressure chamber 205 allowing the safety valve 200 to remain open if desired. Further, this control line 600 can be used to gather more volume for the pressure chamber 205. The control line 600 monitors any volume changes in the pressure chamber 205, allowing for better control of the safety valve 200 from the surface.

In another embodiment, the orifice 208 is not present. Only the control line 600 can relieve the pressure in pressure chamber 205. The pressure in the pressure chamber 205 increases from the static wellbore pressure and can be decreased as desired with the control line 600. With the pressure in the pressure chamber 205 lower than that required to overcome the spring 211 force, the safety valve 200 remains open. In a normal producing well the production fluid pressure acts on surface 209 to act with the spring 211 force in order to keep the safety valve 200 open. An increase in the pressure chamber 205 pressure sufficient to overcome the spring 211 force, but insufficient to overcome the production fluid pressure acting on surface 209 and the spring 211 force will have no effect on the open safety valve 200. If a sudden loss of production fluid pressure occurs in the production tubular the pressure inside the pressure chamber 205 forces the safety valve 200 closed as described above. In this embodiment, however the pressure chamber 205 will not automatically equalize with the production fluid pressure.

In yet another embodiment, the orifice 208 described in the preceding paragraph, operates as a one way valve. The orifice 208 allows fluid from the bore to enter the pressure chamber 205, but not exit. Thus, the pressure in the pressure chamber 205 equalizes with the wellbore pressure, if the control line 600 is not used. In the event of a sudden pressure loss, the flow tube 204 will move upward, allowing the flapper 203 to close, as described above. The pressure chamber 205 is controllable with the control line 600, but is not necessary in order for operation of the valve 200.

After the flapper 203 closed, the pressure of the production fluid acting on the underside of the flapper 203 (pushing upward) is enough to forceably keep the flapper 203 in the closed position. In terms of the pressure chamber 205, it should be noted if the orifice 208 is present the instant of the rapid pressure loss (corresponding to the loss of flow control) the metered flow of fluid through the orifice 208 allows for the pressure equalization process to resume. However, even after the pressure equalizes again, the pressure of the downhole fluid against the bottom-side of the flapper will keep it shut.

Embodiments of the present invention also provide functionality to remotely reopen the subsurface safety valve 200. Obviously, this would be done after the flow control apparatus at the surface of the wellbore is returned to working order. In order to reopen the safety valve 200 from the surface, fluid is pumped down to the safety valve 200 and the pressure is built up so that the pressure above the flapper 203 is the same as the pressure of the production fluid below the flapper 203 (i.e., pressure is equalized across the flapper 203).

It should be noted that by this time, the flow of fluid through the orifice 208 has allowed pressure of fluid within the pressure chamber 205 to again equalize with the pressure of fluid outside the pressure chamber 205. In an embodiment without the orifice 208 the system equalizes when desired by the operator. The spring 211 stays compressed, and the pressure chamber 205 does not return to its previous volume because the flow tube 204 is not allowed to move downwards due to the closed flapper 203.

However, once there is equal pressure on both sides of the flapper 203, the spring 211, biased towards the extended position, will urge the flow tube 204 downwards, which in turn will push the flapper 203 to the open position. Thereafter, the flow tube will bottom out against a corresponding internal shoulder 230 of the bottom sub 202.

With reference to the discussion above, it can be understood that the amount of upward movement of the flow tube 204 is dependent on the difference in pressure (i.e., "pressure drop") between the fluid in the pressure chamber 205 and the pressure of the fluid flowing through the bore of the flow tube 204 at the moment of loss of flow control. In other words, the higher the difference in pressure between the fluid in the pressure chamber 205 and the fluid flowing through the bore of the flow tube 204, the greater the amount of upward movement of the flow tube 204. Maximizing upward movement of the flow tube 204 is important because it ensures that the flow tube 204 does not restrict the flapper 203 from fully closing in the event of a loss of flow control.

Figure 3A:
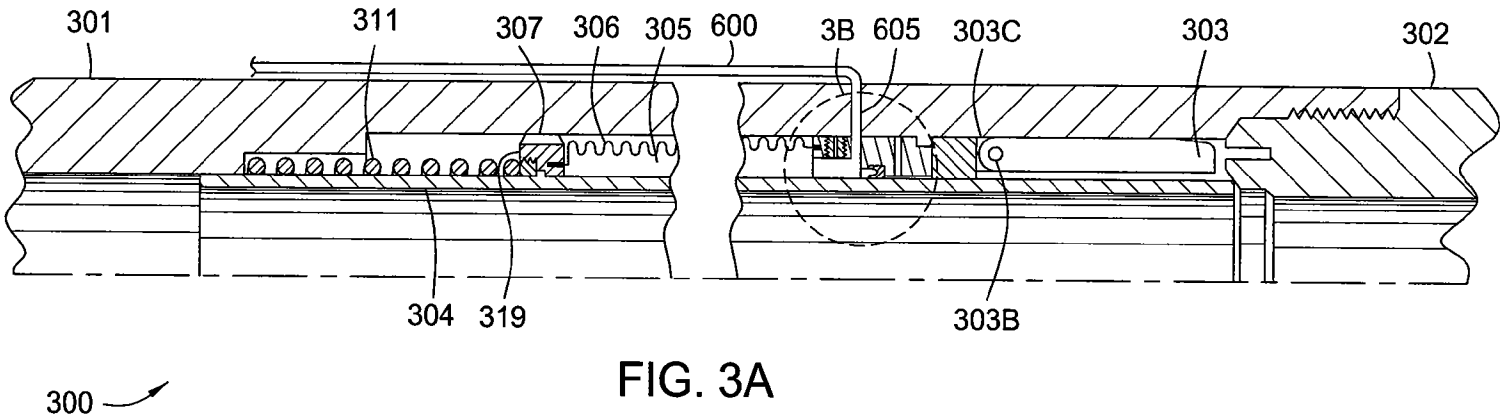
FIGS. 3A and 3B illustrate cross-sectional views of a subsurface safety valve in accordance with an alternative embodiment of the present invention.

Other embodiments of the present invention are envisioned for providing more upward movement of the flow tube for a given pressure drop. FIG. 3A, for instance, illustrates a cross-sectional view of a subsurface safety valve configured with bellows according to an alternative embodiment of the present invention. As will be described below, use of bellows for creating a pressure chamber is beneficial because bellows provide a large change in volume between the compressed and uncompressed position. Greater variance in the volume of the pressure chamber while the safety valve is in the open position versus closed position translates into more axial movement of the flow tube, which ensures complete closure of the flapper.

Referring now to FIG. 3A, a safety valve 300 is provided with a housing 301 that is threadedly connected to a bottom sub 302. Both the housing 301 and the bottom sub 302 are configured with threaded connections to allow for installing the safety valve 300 in a string of production tubing 11.

As with the embodiment described earlier, safety valve 300 comprises a flapper 303 and a flow tube 304. The flapper 303 is rotationally attached by a pin 303B to a flapper mount 303C. The flapper 203 is mechanically or hydraulically biased toward the closed position. The flapper 303 pivots between an open position and a closed position in response to axial movement of the flow tube 304. As shown in FIG. 3A, the safety valve 300 is in the open position; the flow tube 304 restricts the flapper 303 from pivoting. However, with sufficient upward movement of the flow tube 304, the flapper 303 pivots to block the upward flow of production fluid.

An important component of this embodiment is the use of bellows 306 for creating an expandable pressure chamber 305. The bellows 306 may be made of a variety of materials, including, but not limited to metals. For one embodiment, the bellows 306 are configured with pleated metal to facilitate a volumetric variance between its compressed and uncompressed positions.

Figure 3B:
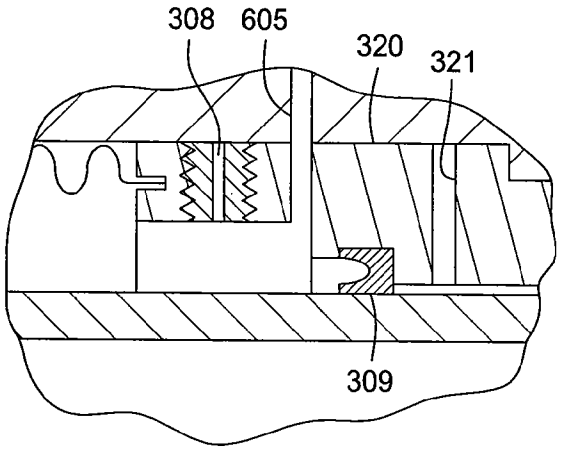

The annular space between the bellows 306 and the flow tube 304 define the pressure chamber 305. The pressure chamber 305 is bound on the top by the connection between the bellows 305 and the bellows retainer 307. The lower end of the pressure chamber 305 is bound by a cap 320. In one embodiment, there are two or more channels by which production fluid can enter the pressure chamber 305: fluid can enter through opening 605 through which control line 600 passes, fluid can go past a packing 309, or fluid can flow into the pressure chamber 305 via an orifice 308. The control line 600 operates in the same manner as described above and can go through any part of the housing 301 so long as it is in fluid communication with the pressure chamber 305. While the valve 300 is in the open position, the fluid flow through the orifice 308 and the packing 309 ensures that the pressure of the fluid inside the pressure chamber 305 is equalized with the pressure of the fluid flowing through the bore of the flow tube 304. FIG. 3B provides a detailed view of the orifice 308 and the packing 309.

In the context of the current application, the packing 309 can be thought of as a one-way valve. As seen in FIG. 3A, the packing 309 is configured to allow fluid to flow into the pressure chamber 305, but not out of it. An orifice 308 is also provided to allow for fluid to flow into the pressure chamber 305. It should be noted that the orifice 308 and control line 600 provide the only paths by which fluid is allowed to flow out of the pressure chamber 305. The orifice 308 meters the fluid that flows through at a relatively low flow rate.

A pressure equalization port 321 extending through the cap 320 is provided to ensure that the pressure on either side of the cap 320 is equalized. Further, the port 321 provides a secondary path for production fluid to reach the packing 309 in the event that the path formed around the bottom end of the flow tube 304 and through the area adjacent to the flapper 303 is plugged.

The safety valve 300 comprises a spring 311 that resists the upward movement of the bellows retainer 307 and the flow tube 304. The bottom of the spring 311 rests against the bellows retainer 307. The top portion of the spring 311 interfaces with a downward-facing internal shoulder of the housing 301. In the open position of the safety valve 300, with the flow tube 304 bottomed out, the spring 311 is fully extended. In the closed position of the safety valve 300, with the flow tube 304 all the way up, the spring 311 is compressed and it exerts a downward force against the bellows retainer 307.

This embodiment operates the same as the previous embodiment. In the event of a loss of flow control at the surface of the wellbore, there would be a pressure drop between the fluid flowing through the bore of the flow tube 304 and the fluid in the pressure chamber 305. As with the previous embodiment, the pressure in the pressure chamber 305 is not reduced in concert with the pressure of the production flow because the metering effect of the orifice 308 does not allow the fluid to flow out of the pressure chamber 305 to allow for pressure equalization to occur immediately. As a result, the pressure chamber 305 expands by extending the bellows 306 axially, which, in turn, urges the bellows retainer 307 and flow tube 304 to move upward, compressing the spring 311. Upon sufficient upward movement of the flow tube 304, the flapper 303 will close to shut-in the wellbore.

Further, the safety valve 300 can be closed at any time through use of the control line 600. The control line 600 monitors and regulates the pressure in the pressure chamber 305 at the surface. To close the safety valve 300 the control line 600 increases the pressure in the pressure chamber 305 which expands the bellows axially until the force acting on a bellow retainer 307 is large enough to overcome the spring 311 force and the pressure acting on a surface 319. The control line 600 can further remove pressure from the pressure chamber 305 allowing the safety valve 300 to remain open if desired. Further, the control line 600 can be used to gather more volume for the pressure chamber 305. The control line 600 can be used to monitor any volume changes in the pressure chamber 305, allowing for better control of the safety valve 300 from the surface.

In another embodiment, the orifice 308 is not present. The flow path past the packing 309 is optional. Without the flow path only the control line 600 controls the pressure in the pressure chamber 305 (described above). The pressure in the pressure chamber 305 increases and decreases as desired with the control line 600. When the pressure in the pressure chamber 305 is lower than that required to overcome the spring 311 force, the safety valve 300 remains open. In a normal producing well the production fluid acts on surface 319 to act with the spring 311 force in order to keep the safety valve 300 open. An increase in the pressure chamber 305 pressure sufficient to overcome the spring 311 force but insufficient to overcome the production fluid pressure acting on surface 319 and the spring 311 force has no effect on the open safety valve. If a sudden loss of fluid pressure occurs in the production tubular the pressure inside the pressure chamber 305 forces the safety valve 300 closed as described above. In this embodiment, however the pressure chamber 305 will not automatically equalize with the production fluid pressure.

In yet another embodiment the flow path past packing 309 is present without the orifice 308. This allows fluid from the bore to enter the pressure chamber 305, but not exit. Thus, the pressure in the pressure chamber 305 equalizes with the wellbore pressure, if the control line 600 is not used. In the event of a sudden pressure loss, the flow tube 304 will move upward allowing the flapper 303 to close, as described above. The pressure chamber 305 is controllable with the control line 600, but it is not necessary in order for operation of the valve 300.

As with the embodiment described earlier with reference to FIGS. 2A and 2B, the valve can be reopened by equalizing pressure on both sides of the flapper 303 and allowing the spring 311 to urge the flow tube 304 downwards. This, in turn, would return the flapper 303 to the open position.

Figure 4A:
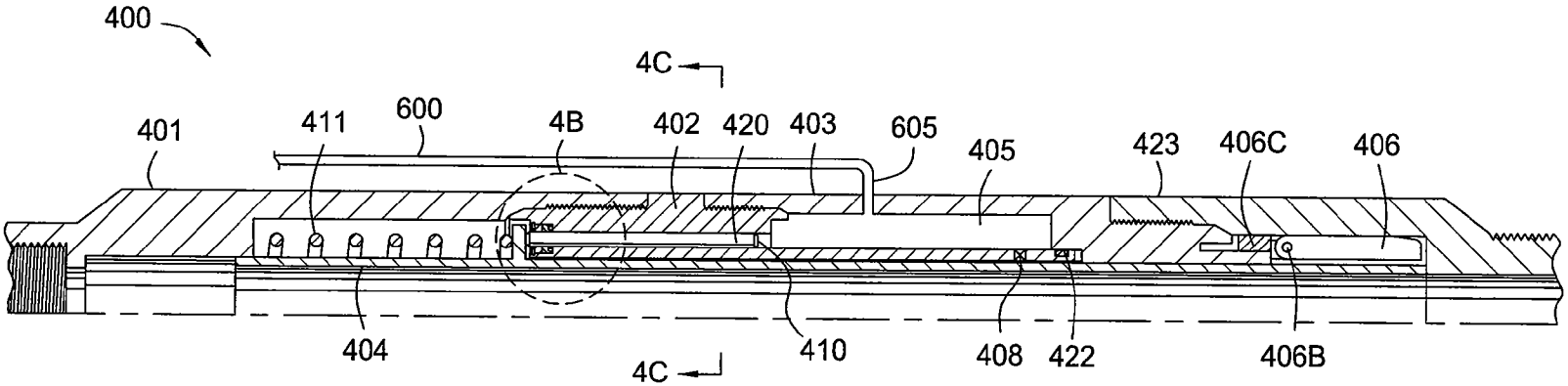
FIGS. 4A-4C illustrate cross-sectional views of a subsurface safety valve in accordance with yet another embodiment of the present invention.

FIG. 4A illustrates yet another embodiment of the present invention that is designed to provide additional axial movement of the flow tube for a given pressure drop. A cross-sectional view of a subsurface safety valve configured with extension rods sliding in their corresponding cylinders is provided. As will be described below, the axial movement of rods for expanding a pressure chamber is beneficial because the process of displacing rods in cylinders with fluid can yield a tremendous amount of axial movement of a flow tube for a given pressure drop. As stated earlier, complete upward movement of the flow tube ensures complete closure of the flapper.

Referring now to FIG. 4A, a safety valve 400 has a housing 401 that is threadedly connected to a crossover sub 402, which is threadedly connected to a lower housing 403. The lower housing 403 connects to a bottom sub 423. Both the housing 401 and the bottom sub 423 are configured with threaded connections to allow for installing the safety valve 400 in a string of production tubing 11. As with previously described embodiments, the safety valve 400 includes a flow tube 404, spring 411 and flapper 406, which is rotationally attached by a pin 406B to a flapper mount 406C, each of which provides generally the same functionality as with other embodiments described above.

The lower end 422 of the crossover sub 402 seals into the lower housing 403. It should be understood that because the lower end 422 of the crossover sub 402 is sealingly connected (e.g., press fit, static seal, etc.) to the lower housing 403, production fluid is not able to flow past the seal between the lower end 422 of the crossover sub 402 and the lower housing 403. However, the lower end 422 of the crossover sub 402 does contain an orifice 408 that allows fluid to flow into and out of a pressure chamber 405. Fluid arrives at the orifice 408 by flowing around the top or bottom of the flow tube 404 and within the annular space between the lower end 422 of the crossover sub 402 and flow tube 404.

Figure 4B:
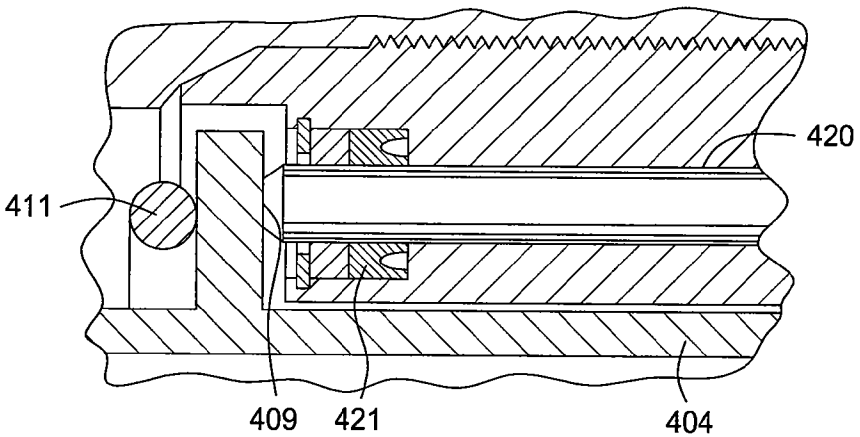

The pressure chamber 405 is defined by the annular space between the lower housing 403 and the lower end of the crossover sub 402. The pressure chamber 405 also includes the bores within the crossover sub 402 in which rods 420 are located. The pressure chamber 405 contains an opening 605 with a control line 600 attached to it. The control line 600 allows for adjustment of the pressure in the pressure chamber 405 from the surface. Fluid can flow into the pressure chamber 405 one or more ways: via the orifice 408, and/or by flowing past rod packings 421 and through the control line 600 as described above. As with the packing 309 described with reference to the previous embodiment, rod packings 421 function as one-way valves, wherein fluid is allowed to flow into the pressure chamber 405 (downwards) past the rods 420, but the fluid is not allowed to flow out from the pressure chamber 405 (upward) past the interface between the rods 420 and the rod packings 421. FIG. 4B provides a detailed view of the interface between a rod 420 and a rod packing 421.

During normal operation, while the valve 400 is in the open position, the pressure chamber 405 is filled with the production fluid. While the valve 400 is in the open position, the fluid flow into the pressure chamber 405 ensures that the pressure of the fluid inside the chamber is equalized with the pressure of the fluid flowing through the bore of the flow tube 404.

In the event of a sudden pressure drop, as described in the previous embodiments, the fluid is not capable of immediately exiting the pressure chamber via the orifice 408 (for purposes of pressure equalization), so the pressure in pressure chamber 405 is higher than the pressure of the flowing production fluid. Consequently, the pressure chamber 405 expands and displaces the rods 420 upward from the cylinders. The rods 420 move the flow tube 404 upward against the spring 411. After the flow tube 404 has moved sufficiently upward, the flapper 406 closes and shuts-in the well.

Further, the safety valve 400 can close at any time through use of control line 600. The control line 600 monitors and regulates the pressure in the pressure chamber 405 at the surface. To close the safety valve 400 the control line 600 increases the pressure in the pressure chamber 405 until the pressure acting on a surface 410 of the piston 420 is large enough to overcome the spring 411 force and the pressure acting on a surface 409. The control line 600 can further remove pressure from the pressure chamber 405 allowing the safety valve 400 to remain open if desired. Further, this control line 600 can be used to gather more volume for the pressure chamber 405. The control line 600 monitors any volume changes in the pressure chamber 405, allowing for better control of the safety valve 400 from the surface.

In another embodiment, the orifice 408 is not present. The flow path past the rod packings 421 is optional. Without the flow path only the control line 600 controls the pressure in the pressure chamber 405 (described above). The pressure in the pressure chamber 405 increases and decreases as desired with the control line 600. With the pressure in the pressure chamber 405 is lower than that required to overcome the spring 411 force, the safety valve 400 remains open. If a sudden loss of fluid pressure occurs in the production tubular, the pressure inside the pressure chamber 405 forces the safety valve 400 to close as described above. In this embodiment, however, the pressure chamber 405 will not automatically equalize with the production fluid pressure.

In yet another embodiment the flow path past rod packings 421 is present without the orifice 408. This allows fluid from the bore to enter the pressure chamber 405, but not exit. Thus, the pressure in the pressure chamber 405 equalizes with the wellbore pressure, if the control line 600 is not used. In the event of a sudden pressure loss the flow tube 404 will move upward, allowing the flapper 406 to close, as described above. The pressure chamber 405 is controllable with the control line 600, but it is not necessary in order for operation of the valve 400.

Figure 4C:
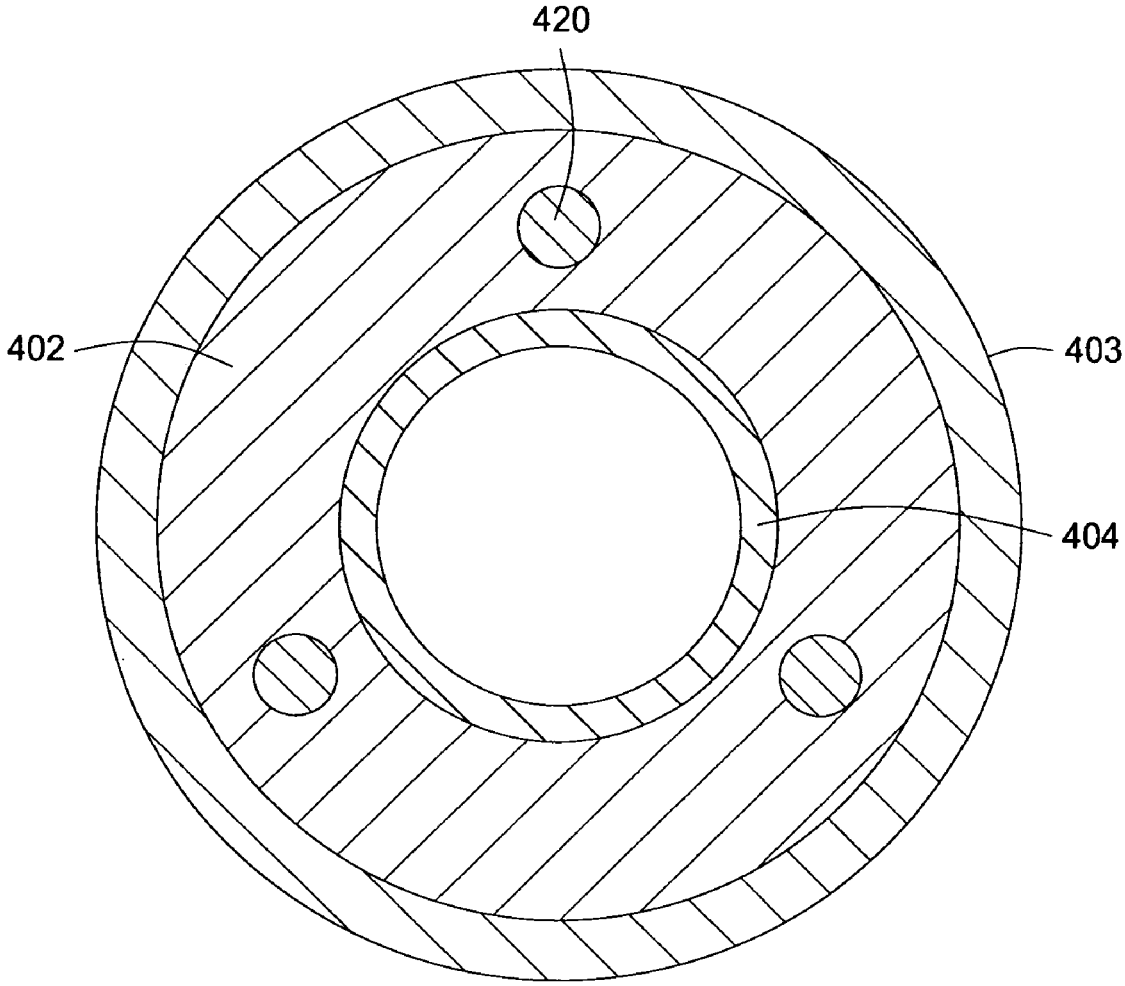

It can be seen from FIG. 4C that the collective cross-sectional area of rods 420 is considerably less than the annular area between the inner diameter of the lower housing 403 and the lower end of the crossover sub 402. Accordingly, the use of rods 420 in this manner requires less expansion of pressure chamber 405 to achieve the required amount of axial movement of the flow tube 404 to allow the flapper 403 to close. This is because the volumetric change of the pressure chamber 405 need only be enough to displace the volume of the rods 420, rather than the entire annular area between the lower mandrel and the flow tube 404. While three rods 420 are shown for the current embodiment, it should be understood that the number of rods can vary based on the requirements of a particular implementation.

Those skilled in the art will recognize that safety valves according to embodiments of the present invention may be utilized in any wellbore implementation where a pressure differential (i.e. pressure drop) may arise. For instance, the safety valves described herein are fully functional if there is a pressure differential between fluid in the pressure chamber and fluid flowing through the bore of the safety valve, regardless of the absolute pressures of the respective fluids. Therefore, safety valves according to embodiments of the present invention may be utilized in low pressure wellbores as well as high pressure wellbores.

While the exemplary safety valves described herein are configured for use with production tubing, those skilled in the art will acknowledge that embodiments of the present invention may be configured for use in a variety of wellbore implementations. For example, some embodiments of the present invention may be implemented as safety valves configured for use with wireline. Yet other embodiments may be configured for use with drill pipe or coiled tubing.

Figure 5:
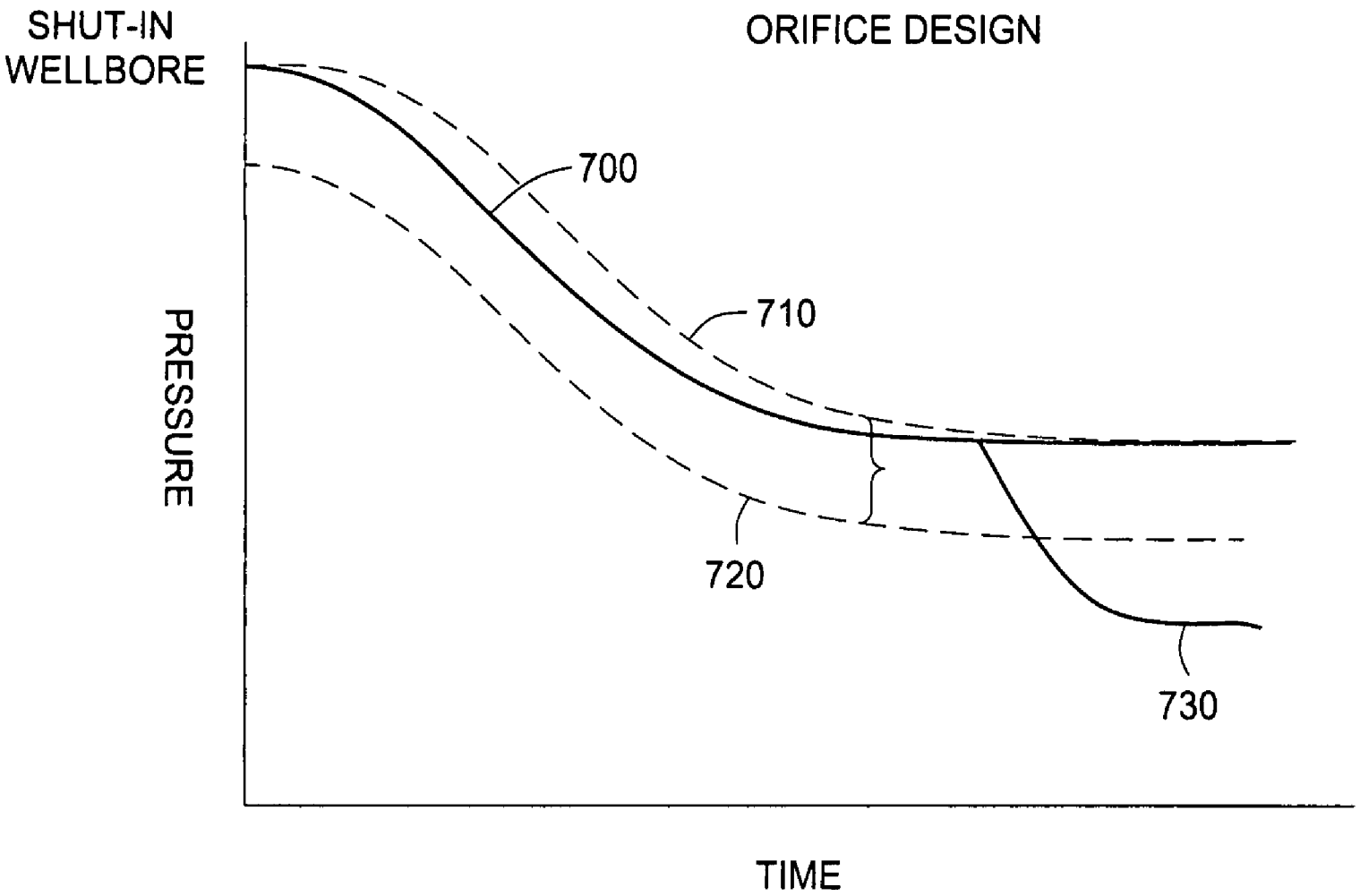
FIG. 5 is a chart illustrating the operation of the subsurface safety valve when an orifice design is used.

FIG. 5 illustrates a chart for the operation of the safety valve 200, 300 and 400 with use of the orifice 208, 308 and 408. As shown the solid line 700 represents the flowing wellbore pressure. The upper dashed line 710 represents the pressure in the pressure chamber 205, 305 and 405, and the distance between the upper dashed line 710 and the lower dashed line 720 represents the pressure drop required in the wellbore to close the valve 200, 300 and 400. As can be seen as the wellbore pressure decreases naturally the pressure in the pressure chamber 205, 305 and 405 also decreases, which enables the valve 200, 300 and 400 to remain open. If a sudden drop in wellbore pressure occurs as shown by the solid line branch 730 the valve 200, 300 and 400 closes upon the line reaching the pressure of the lower dashed line 720. If need be, the pressure in the pressure chamber can increase or decrease with the control line and the valve 200, 300 and 400 could be closed or remain open.

Figure 6:
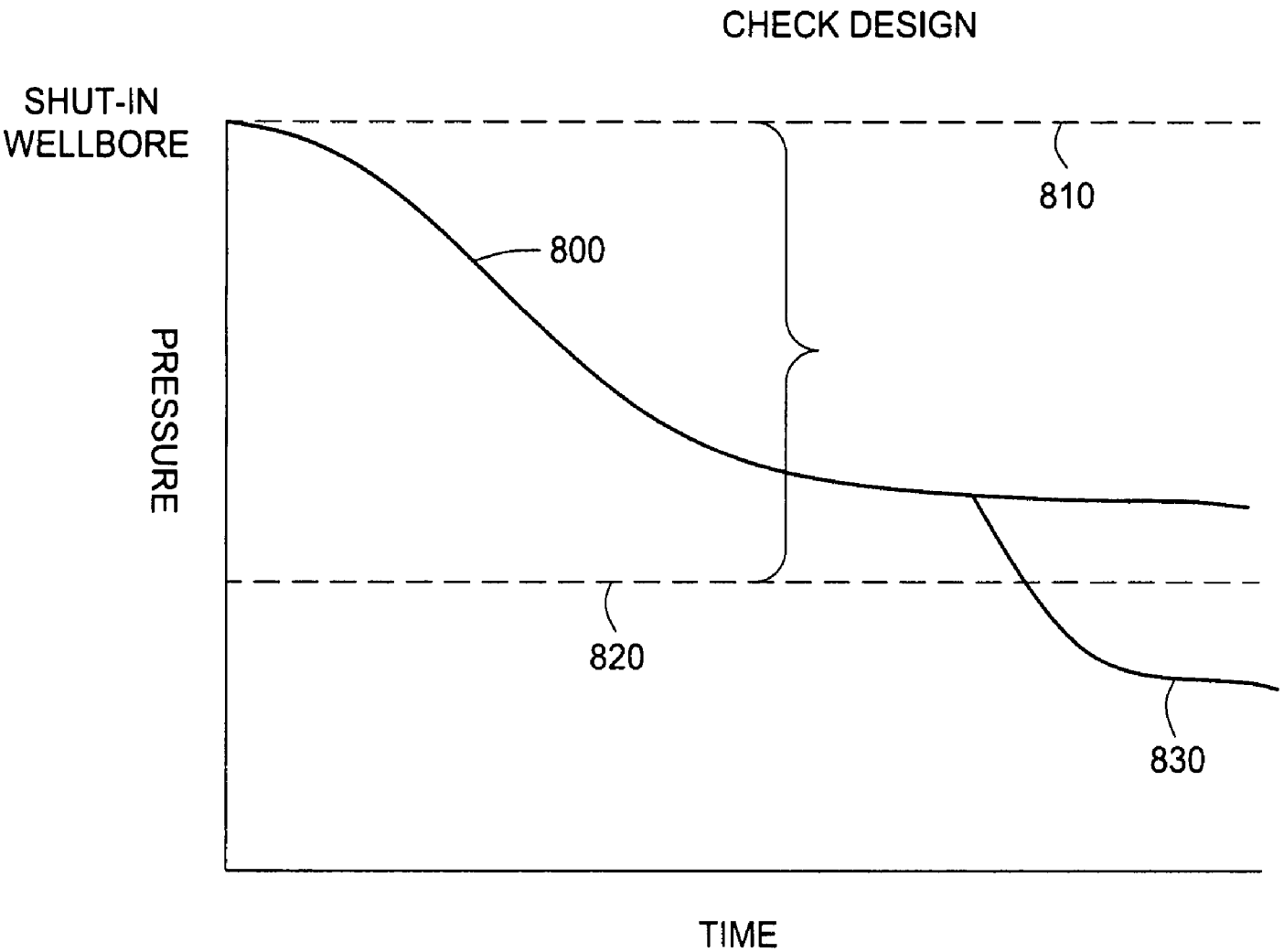
FIG. 6 is a chart illustrating the operation of the subsurface safety valve with no orifice.

FIG. 6 illustrates a chart for the operation of the safety valve 200, 300, and 400 without use of the orifice 208, 308, and 408. As shown the solid line 800 represents the natural wellbore pressure. The upper dashed line 810 represents the pressure in the pressure chamber 205, 305, and 405, and the distance between the upper dashed line 810 and the lower dashed line 820 represents the pressure drop required in the wellbore to close the valve 200, 300, and 400. As can be seen as the wellbore pressure decreases naturally the pressure in the pressure chamber 205, 305, and 405 remains constant. Therefore as the wellbore pressure naturally decreases the pressure required to overcome the spring 211, 311, and 411 and wellbore pressure decreases. In this case, a stronger spring 211, 311, and 411 may be required in order to ensure the valve 200, 300, and 400 does not close during normal operation. If a sudden drop in wellbore pressure occurs as shown by the solid line branch 830 the valve 200, 300, and 400 closes upon the line 830 reaching the pressure of the lower dashed line 820. If need be, the pressure in the pressure chamber 205, 305, and 405 can increase or decrease with the control line 600 and the valve 200, 300, and 400 could be closed or remain open.

While the foregoing is directed to embodiments of the present invention, other and further embodiments of the invention may be devised without departing from the basic scope thereof, and the scope thereof is determined by the claims that follow.

The invention claimed is:

1. A method of operating a downhole valve comprising:
providing the valve in a downhole tubular, the valve having:
a closing member for sealing a bore;
a retention member having a first and second piston surface substantially isolated from each other, the retention member mechanically biased to interfere with the closing member to keep the valve open;
a pressure chamber in communication with the second piston surface; and
a control line in communication with the pressure chamber;
applying a wellbore pressure to the first piston surface;
increasing the pressure in the pressure chamber to a level sufficient to overcome the mechanical bias of the retention member, but insufficient to overcome both the pressure on the first piston surface and the mechanical bias,
wherein the pressure in the pressure chamber is increased to the wellbore pressure through a metered flow orifice.

2. The method of claim 1, further comprising closing the valve upon a sudden loss of wellbore pressure.

3. The method of claim 2, further comprising equalizing the pressure in the pressure chamber with the wellbore pressure.

4. The method of claim 3, further comprising opening the valve.

5. The method of claim 1, wherein the pressure in the pressure chamber is increased by the control line.

6. The method of claim 1, further comprising decreasing the pressure in the pressure chamber through the metered flow orifice as the wellbore pressure gradually decreases.

7. The method of claim 6, further comprising closing the valve upon a sudden loss of wellbore pressure.

8. The method of claim 1, wherein the pressure in the pressure chamber is also increased to the wellbore pressure through a one way flow path.

9. A safety valve for use in a wellbore, comprising:
a tubular housing having:
a wall,
a longitudinal bore defined by the interior of the wall, and
a port formed through the wall for receiving a control line;
a closing member operably coupled to the housing between:
an open position where the closing member permits flow through the bore, and
a closed position where the closing member seals the bore; and a piston:
disposed in the housing,
having a first portion in fluid communication with the port and in limited fluid communication with the bore,
having a second portion substantially isolated from the first portion and in fluid communication with the bore,
operable to allow closure of the closing member in response to fluid pressure exerted on the first portion exceeding pressure exerted on the second portion, and
operable to open the closing member in response to pressure exerted on the second portion exceeding fluid pressure exerted on the first portion.

10. The safety valve of claim 9, further comprising a biasing member disposed in the housing and biasing the closing member toward the open position.

11. The safety valve of claim 9, wherein the limited fluid communication is unidirectional.

12. The safety valve of claim 9, further comprising a seal disposed between the portions.

13. The safety valve of claim 9, further comprising a bellows disposed between the portions.

14. The safety valve of claim 9, further comprising a unidirectional packing disposed between the portions.

15. The safety valve of claim 9, wherein the piston comprises a flow tube or the safety valve further comprises a flow tube attached to the piston.

16. The safety valve of claim 15, wherein:
a recess is formed in the housing wall, and
a seal is disposed between the housing and the flow tube.

17. The safety valve of claim 16, wherein:
the flow tube has a shoulder extending into the recess,
the piston portions are surfaces of the shoulder, and
the shoulder has a seal disposed therein.

18. The safety valve of claim 17, wherein the flow tube has an orifice disposed through a wall thereof.

19. The safety valve of claim 17, further comprising a spring disposed in a pressure chamber between the flow tube and the housing, the spring biasing the closing member toward the open position.

20. The safety valve of claim 16, wherein the seal is a unidirectional packing.

21. The safety valve of claim 16, wherein the piston comprises a bellows attached to the flow tube and the housing.

22. The safety valve of claim 21,
further comprising a cap disposed in the recess and attached to the housing,
wherein:
the bellows is attached to the cap,
the seal is disposed between the cap and the housing, and
an orifice is formed through the cap.

23. The safety valve of claim 15, wherein:
the closing member is a flapper,
the flow tube is operable to engage the flapper and push the flapper to the open position,
the flow tube allows the flapper to move to the closed position by moving away from the flapper,
the safety valve further comprises a biasing member biasing the flow tube toward the flapper, and
the piston is operable to move the flow tube away from the flapper.

24. The safety valve of claim 9, wherein the piston comprises a rod and the safety valve further comprises a flow tube operably coupled to the piston.

25. The safety valve of claim 24, wherein:
the housing has a pressure chamber formed therein in fluid communication with the port,
the piston is disposed in the housing wall, and
a seal is disposed between the piston and the housing.

26. The safety valve of claim 25, wherein the housing has an orifice formed therein.

27. The safety valve of claim 25, wherein the seal is a unidirectional packing.

28. The safety valve of claim 25, wherein:
the closing member is a flapper,
the flow tube is operable to engage the flapper and push the flapper to the open position,
the flow tube allows the flapper to move to the closed position by moving away from the flapper,
the safety valve further comprises a biasing member biasing the flow tube toward the flapper, and
the piston is operable to move the flow tube away from the flapper.

29. The safety valve of claim 25, wherein:
the housing comprises a first section, a second section, and a third section,
the sections are connected by threaded connections,
the piston is disposed in the second section,
the pressure chamber is formed between the second and third sections, and
the seal is disposed between the piston and the second section.

30. The safety valve of claim 9, wherein closing member is a flapper and the safety valve further comprises a spring biasing the flapper toward the closed position.

31. A safety valve for use in a wellbore, comprising:
a tubular housing having:
a wall,
a longitudinal bore defined by the interior of the wall, and
a port formed through the wall for receiving a control line;
a closing member operably coupled to the housing between:
an open position where the closing member permits flow through the bore, and
a closed position where the closing member seals the bore; and a piston:
disposed in the housing,
having a first portion in fluid communication with the port and in limited fluid communication with the bore,
having a second portion isolated from the first portion and in fluid communication with the bore, and
operable to close the closing member in response to sufficient fluid pressure exerted on the first portion.

32. The safety valve of claim 31, wherein the limited fluid communication is unidirectional.

33. A safety valve for use in a wellbore, comprising:
a tubular housing having:
a wall,
a longitudinal bore defined by the interior of the wall, and
a port formed through the wall for receiving a control line;
a closing member operably coupled to the housing between:
an open position where the closing member permits flow through the bore, and
a closed position where the closing member seals the bore; and a piston:
disposed in the housing,
having a first portion in fluid communication with the port,
having a second portion isolated from the first portion and in fluid communication with the bore, and
operable to close the closing member in response to sufficient fluid pressure exerted on the first portion,
wherein:
the piston comprises a flow tube or the safety valve further comprises a flow tube attached to the piston,
a recess is formed in the housing wall,
a seal is disposed between the housing and the flow tube and isolates a pressure chamber of the recess from the bore
the flow tube has a shoulder extending into the recess,
the piston portions are surfaces of the shoulder,
the shoulder has a seal disposed therein, and
the flow tube has an orifice disposed through a wall thereof providing limited fluid communication between the pressure chamber and the bore.

34. The safety valve of claim 33, further comprising a spring disposed in the pressure chamber between the flow tube and the housing, the spring biasing the closing member toward the open position.

35. A safety valve for use in a wellbore, comprising:
a tubular housing having:
a wall,
a longitudinal bore defined by the interior of the wall, and
a port formed through the wall for receiving a control line;

a closing member operably coupled to the housing between:

an open position where the closing member permits flow through the bore, and a closed position where the closing member seals the bore; and a piston:

disposed in the housing, having a first portion in fluid communication with the port, having a second portion isolated from the first portion and in fluid communication with the bore, and operable to close the closing member in response to sufficient fluid pressure exerted on the first portion, wherein:

the piston comprises a flow tube or the safety valve further comprises a flow tube attached to the piston a recess is formed in the housing wall, a seal is disposed between the housing and the flow tube and isolates a pressure chamber of the recess from the bore, the piston comprises a bellows attached to the flow tube and the housing and further isolating the pressure chamber from the bore, the safety valve further comprises a cap disposed in the recess and attached to the housing, the bellows is attached to the cap, the seal is disposed between the cap and the housing, and an orifice is formed through the cap and in communication with the pressure chamber and the bore.

36. A method for producing hydrocarbons from a wellbore, comprising:

flowing hydrocarbons through a bore of a production tubing string disposed in the wellbore, the production tubing string comprising:

a closing member, a chamber in fluid communication with a control line extending to the surface, and a piston:

operably coupled to the closing member, having a first portion in fluid communication with the chamber, and having a second portion at least substantially isolated from the first portion and in fluid communication with the bore; and maintaining a pressure in the chamber substantially equal to a steady state pressure exerted on the second portion by the flowing hydrocarbons, thereby keeping the closing member in an open position and storing sufficient fluid energy in the chamber to automatically close the closing member in response to a surge in the flow of hydrocarbons through the bore.

37. The method of claim 36, wherein the production tubing string further comprises a biasing member biasing the closing member toward the open position.

38. The method of claim 36, wherein the chamber pressure is automatically maintained by limited fluid communication between the chamber and the bore.

39. The method of claim 36, wherein the chamber pressure is maintained by controlling pressure in the control line.

40. The method of claim 36, wherein the closing member is a flapper and the piston is a shoulder of a flow tube.

41. The method of claim 40, wherein the production tubing string further comprises a spring biasing the flow tube into engagement with the flapper.

42. The method of claim 36, wherein the piston comprises a bellows.

43. The method of claim 42, wherein:

the closing member is a flapper, the production tubing string further comprises a flow tube coupled to the bellows.

44. The method of claim 43, wherein the production tubing string further comprises a spring biasing the flow tube into engagement with the flapper.

45. The method of claim 36, wherein:

the closing member is a flapper, the production tubing string further comprises a flow tube, and the piston is a rod operably coupled to the flow tube.

46. The method of claim 45, wherein the production tubing string further comprises a spring biasing the flow tube into engagement with the flapper.

47. A safety valve for use in a wellbore, comprising:

a tubular housing having:

a wall, a longitudinal bore defined by the interior of the wall, and a port formed through the wall for receiving a control line;

a closing member operably coupled to the housing between:

an open position where the closing member permits flow through the bore, and a closed position where the closing member seals the bore; and a piston:

disposed in the housing, having a first portion in fluid communication with the port, having a second portion in fluid communication with the bore, and operable to allow closure of the closing member in response to fluid pressure exerted on the first portion exceeding pressure exerted on the second portion, operable to open the closing member in response to pressure exerted on the second portion exceeding fluid pressure exerted on the first portion; and a unidirectional packing disposed between the portions.

48. A safety valve for use in a wellbore, comprising:

a tubular housing having:

a wall, a longitudinal bore defined by the interior of the wall, and a port formed through the wall for receiving a control line;

a closing member operably coupled to the housing between:

an open position where the closing member permits flow through the bore, and a closed position where the closing member seals the bore;

a pressure chamber in fluid communication with the port and operable to store sufficient fluid energy to automatically close the closing member in response to a surge in flow through the bore; and a piston:

disposed in the housing, operatively coupled to the closing member, and having a first portion in fluid communication with the pressure chamber and a second portion at least substantially isolated from the first portion and in communication with the bore, wherein the pressure chamber is in limited fluid communication with the bore.

49. The safety valve of claim 48, wherein the piston is operable to open the closing member in response to pressure exerted on the second portion exceeding fluid pressure exerted on the first portion.

50. The safety valve of claim 49, wherein the piston is further operable to allow closure of the closing member in response to fluid pressure exerted on the first portion exceeding pressure exerted on the second portion.

51. The safety valve of claim 48, further comprising a spring biasing the closing member toward the open position.

* * * * *